US008386245B2

(12) United States Patent
Gao

(10) Patent No.: US 8,386,245 B2
(45) Date of Patent: Feb. 26, 2013

(54) OPEN-LOOP PITCH TRACK SMOOTHING

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 1233 days.

(21) Appl. No.: 12/224,003

(22) PCT Filed: Oct. 27, 2006

(86) PCT No.: PCT/US2006/042096

§ 371 (c)(1),
(2), (4) Date: Aug. 12, 2008

(87) PCT Pub. No.: WO2007/111649

PCT Pub. Date: Oct. 4, 2007

(65) Prior Publication Data

US 2010/0241424 A1 Sep. 23, 2010

Related U.S. Application Data

(60) Provisional application No. 60/784,384, filed on Mar. 20, 2006.

(51) Int. Cl.
*G10L 11/04* (2006.01)
*G10L 19/00* (2006.01)

(52) U.S. Cl. ..... 704/207; 704/205; 704/216

(58) Field of Classification Search ..... 704/201, 704/205–207, 216

See application file for complete search history.

(56) References Cited

U.S. PATENT DOCUMENTS

| | | | | |
|---|---|---|---|---|
| 5,495,555 | A | 2/1996 | Swaminathan | |
| 5,596,676 | A | 1/1997 | Swaminathan | |
| 5,732,389 | A | 3/1998 | Kroon et al. | |
| 5,909,663 | A | 6/1999 | Iijima | |
| 6,199,035 | B1 | 3/2001 | Lakaniemi et al. | |
| 6,260,010 | B1 | 7/2001 | Gao et al. | |
| 6,507,814 | B1 | 1/2003 | Gao | |
| 6,564,182 | B1 * | 5/2003 | Gao | 704/207 |
| 7,136,810 | B2 * | 11/2006 | Paksoy et al. | 704/219 |
| 7,146,309 | B1 * | 12/2006 | Benyassine et al. | 704/201 |
| 7,457,744 | B2 * | 11/2008 | Lee et al. | 704/207 |
| 2005/0015243 | A1 * | 1/2005 | Lee et al. | 704/219 |
| 2005/0021325 | A1 * | 1/2005 | Seo et al. | 704/207 |
| 2009/0024386 | A1 * | 1/2009 | Su et al. | 704/201 |

OTHER PUBLICATIONS

Hwang, S., *Computational Improvement for G. 729 Standard*, Electronics Letters (Jun. 2000), pp. 1163-1164.

*Coding of Speech at 8 kbit/s Using Conjugate-Structure Algebraic-Code-Excited Linear-Prediction* (*SC-ACELP*), International Telecommunication Union, ITU-T Recommendation G.729, 1-35 (Mar. 1996).

* cited by examiner

*Primary Examiner* — James Wozniak
(74) *Attorney, Agent, or Firm* — Farjami & Farjami LLP

(57) ABSTRACT

There is provided a speech encoder for performing an algorithm that comprises obtaining (205) a plurality of open-loop pitch candidates from a current frame of a speech signal, the plurality of open-loop pitch candidates including a first open-loop pitch candidate and a second open-loop pitch candidate; obtaining (205) a voicing information from one or more previous frames; and selecting (280) one of the plurality of open-loop pitch candidates as a final pitch of the current frame using the voicing information from the one or more previous frames. In one aspect, the voicing information from the one or more previous frames includes a previous pitch of the one or more previous frames. In a further aspect, selecting the final pitch of the current frame includes selecting (210) an initial open-loop pitch from that has the maximum long-term correlation value.

22 Claims, 3 Drawing Sheets

OPEN-LOOP PITCH TRACK SMOOTHING

RELATED APPLICATIONS

The present U.S. national phase application is based on, and claims priority from, PCT application Ser. No. PCT/US06/42096, filed on Oct. 27, 2006, which claims priority to U.S. Provisional Application Ser. No. 60/784,384, filed Mar. 20, 2006, which are hereby incorporated by reference in their entirety.

BACKGROUND OF THE INVENTION

1. Field of the Invention

The present invention relates generally to speech coding. More particularly, the present invention relates to open-loop pitch analysis.

2. Related Art

Speech compression may be used to reduce the number of bits that represent the speech signal thereby reducing the bandwidth needed for transmission. However, speech compression may result in degradation of the quality of decompressed speech. In general, a higher bit rate will result in higher quality, while a lower bit rate will result in lower quality. However, modern speech compression techniques, such as coding techniques, can produce decompressed speech of relatively high quality at relatively low bit rates. In general, modern coding techniques attempt to represent the perceptually important features of the speech signal, without preserving the actual speech waveform. Speech compression systems, commonly called codecs, include an encoder and a decoder and may be used to reduce the bit rate of digital speech signals. Numerous algorithms have been developed for speech codecs that reduce the number of bits required to digitally encode the original speech while attempting to maintain high quality reconstructed speech.

In 1996, the Telecommunication Sector of the International Telecommunication Union (ITU-T) adopted a toll quality speech coding algorithm known as the G.729 Recommendation, entitled "Coding of Speech Signals at 8 kbit/s using Conjugate-Structure Algebraic-Code-Excited Linear-Prediction (CS-ACELP)," which is hereby incorporated by reference in its entirety into the present application.

FIG. 1 illustrates the speech signal flow in CS-ACELP (Conjugate Structure Algebraic-Code-Excited-Linear-Prediction) encoder 100 of the G.729 Recommendation, as explained therein. The reference numerals adjacent to each block in FIG. 1 indicate section numbers within the G.729 Recommendation that describe the operation and functionality of each block. As shown, the speech signal or input samples 105 enter the high pass & down scale block (described in Section 3.1 of the G.729 Recommendation), where pre-processing 110 is applied to input samples 105 on a frame-by-frame basis. Next, LP analysis 115 and open-loop pitch search 120 are applied to the pre-processed speech signal on a frame-by-frame basis. Following the open-loop pitch search 120, closed-loop pitch search 125 and algebraic search 130 are applied to the speech signal on a subframe-by-subframe basis, as shown in FIG. 1, which results in generating code index output 135.

As illustrated in FIG. 1, open-loop pitch search 120 includes find open-loop pitch delay 124, which is described at Section 3.4 of the G.729 Recommendation. As explained therein, to reduce the complexity of the search for the best adaptive-codebook delay, the search range is limited around a candidate delay $T_{op}$, obtained from an open-loop pitch analysis. This open-loop pitch analysis is done once per frame (10 ms). The open-loop pitch estimation uses the weighted speech signal sw(n) from compute weighted speech 122, and is implemented as follows.

In the first step, three maxima of correlation:

$$R(k) = \sum_{n=0}^{79} sw(n)sw(n-k)$$

where, $$sw(n) = s(n) + \sum_{i=1}^{10} a_i y_1^i s(n-i) - \sum_{i=1}^{10} a_i y_2^i sw(n-i)$$

$$n = 0, \ldots, 39$$

are found in the following three ranges:

i=1:80, . . . , 143 i=2:40, . . . , 79 i=3:20, . . . , 39

The retained maxima $R(t_i)$, i=1, . . . , 3, are normalized through:

$$R'(t_i) = \frac{R(t_i)}{\sqrt{\sum_n sw^2(n-t_i)}}$$

$$i = 1, \ldots, 3$$

Next, the winner among the three normalized correlations is selected by favoring the delays with the values in the lower range. This is done by weighting the normalized correlations corresponding to the longer delays. The best open-loop delay $T_{op}$ is determined as follows:

```
T_op = t_1
R'(T_op) = R'(t_1)
if R'(t_2) ≧ 0.85R'(T_op)
    R'(T_op) = R'(t_2)
    T_op = t_2
end
if R'(t_3) ≧ 0.85R'(T_op)
R'(T_op) = R'(t_3)
    T_op = t_3
end
```

The above-described procedure of dividing the delay range into three sections and favoring the smaller values is used to avoid choosing pitch multiples. The smoothed open-loop pitch track can help stabilize the speech perceptual quality. More specifically, smoothed pitch track can make pitch prediction (pitch estimation for lost frames) easier when applying frame erasure concealment algorithm at the decoder side. The above-described conventional algorithm of the G.729 Recommendation, however, does not provide an optimum result and can be further improved. For example, disadvantageously, the conventional algorithm of the G.729 Recommendation only uses the current frame information to smooth the open-loop pitch track in order to avoid pitch multiples.

Accordingly, there is a need in the art to improve conventional open-loop pitch analysis to obtain a smoother open-loop pitch track for stabilizing the speech perceptual quality.

SUMMARY OF THE INVENTION

The present invention is directed to system and method for performing an open-loop pitch analysis. In one aspect, a speech encoder performs an algorithm that comprises obtaining a plurality of open-loop pitch candidates including a first open-loop pitch candidate (p_max1), a second open-loop pitch candidate (p_max2) and a third open-loop pitch candidate (p_max3), wherein p_max1>p_max2>p_max3; obtaining a plurality of long-term correlation values, including a first correlation value (max1), a second correlation value (max2) and a third correlation value (max3), for each corresponding one of the plurality of open-loop pitch candidates; and selecting an initial open-loop pitch (max) from the plurality of open-loop pitch candidates, wherein the long-term correlation value corresponding to max (p_max) has the maximum long-term correlation value among the long-term correlation values.

The algorithm also comprises determining if p_max2 is less than p_max, and if so, the algorithm includes setting a first threshold value to a first pre-determined threshold value if an absolute value of a previous pitch less p_max2 is less than a first pre-determined comparison value and setting the first threshold value to a second pre-determined threshold value if the absolute value of the previous pitch less p_max2 is not less than the first pre-determined comparison value; and if max multiplied by the first threshold value is less than max2, setting max to max2 and p_max to p_max2. The algorithm further comprises determining if p_max3 is less than p_max, and if so, the algorithm includes setting a second threshold value to a third pre-determined threshold value if an absolute value of a previous pitch less p_max3 is less than a second pre-determined comparison value and setting the second threshold value to a fourth pre-determined threshold value if the absolute value of the previous pitch less p_max3 is not less than the second pre-determined comparison value; and if max multiplied by the second threshold value is less than max3, setting p_max to p_max3.

In a further aspect, the first pre-determined comparison value is 10, the first pre-determined threshold value is 0.7 and the second pre-determined threshold value is 0.9, and the second pre-determined comparison value is 5, the third pre-determined threshold value is 0.7 and the fourth pre-determined threshold value is 0.9.

In another aspect, the previous pitch is from one or more previous frames. In yet another aspect, the previous pitch is from an immediate previous frame.

In a separate aspect, a speech encoder performs an algorithm that comprises obtaining a plurality of open-loop pitch candidates including a first open-loop pitch candidate (p_max1), a second open-loop pitch candidate (p_max2) and a third open-loop pitch candidate (p_max3), wherein p_max1>p_max2>p_max3; obtaining a plurality of long-term correlation values, including a first correlation value (max3), a second correlation value (max2) and a third correlation value (max3), for each corresponding one of the plurality of open-loop pitch candidates; selecting an initial open-loop pitch (max) from the plurality of open-loop pitch candidates, wherein the long-term correlation value corresponding to max (p_max) has the maximum long-term correlation value among the long-term correlation values; if p_max2 is less than p_max, setting max to max2 and p_max to p_max2 based on a first decision; and if p_max3 is less than p_max, setting p_max to p_max3 based on a second decision.

In a further aspect, the open-loop pitch analysis algorithm may further comprise obtaining a voicing information from one or more previous frames; and using the voicing information from the one or more previous frames for each of the first decision and the second decision. In one aspect, the voicing information from the one or more previous frames includes a previous pitch of the one or more previous frames. Yet, in another aspect, the voicing information from the one or more previous frames is a pitch from an immediate previous frame.

In an additional aspect, the first decision includes setting a first threshold value to a first pre-determined threshold value if an absolute value of a previous pitch less p_max2 is less than a first pre-determined comparison value and setting the first threshold value to a second pre-determined threshold value if the absolute value of the previous pitch less p_max2 is not less than the first pre-determined comparison value; and determining if max multiplied by the first threshold value is less than max2, where the first pre-determined comparison value is 10, the first pre-determined threshold value is 0.7 and the second pre-determined threshold value is 0.9.

These and other aspects of the present invention will become apparent with further reference to the drawings and specification, which follow. It is intended that all such additional systems, features and advantages be included within this description, be within the scope of the present invention, and be protected by the accompanying claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
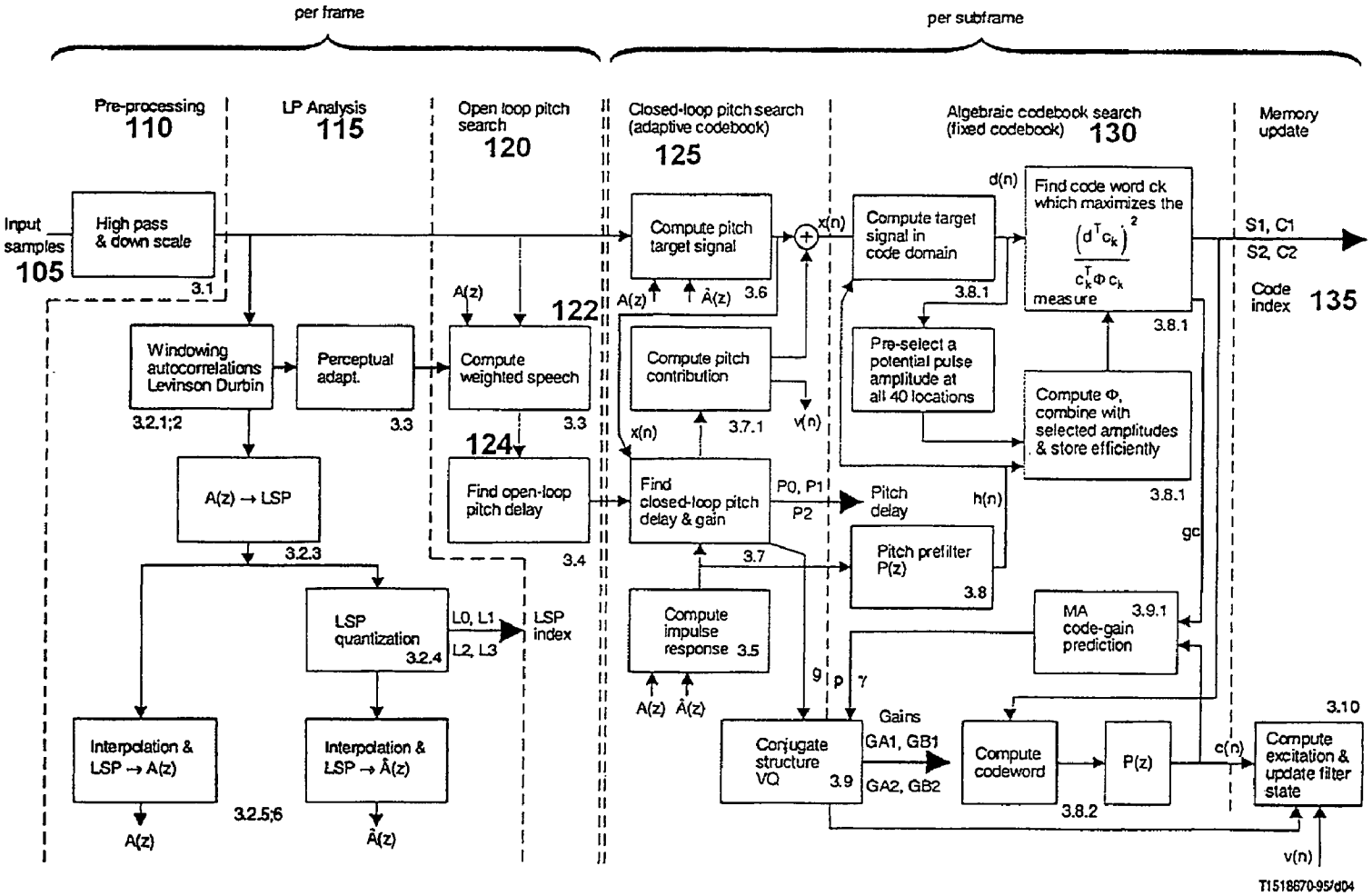
FIG. 1 (Prior Art)
FIG. 1 illustrates the speech signal flow in a CS-ACELP encoder of the G.729 Recommendation, including a find open-poop pitch delay module performing a conventional open-loop pitch analysis algorithm.

Although the invention is described with respect to specific embodiments, the principles of the invention, as defined by the claims appended herein, can obviously be applied beyond the specifically described embodiments of the invention described herein. For example, although various embodiments of the present invention are described in conjunction with the encoder of the G.729 Recommendation, the invention of the present application is not limited to a particular standard, but may be utilized in any system. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

Figure 2A:
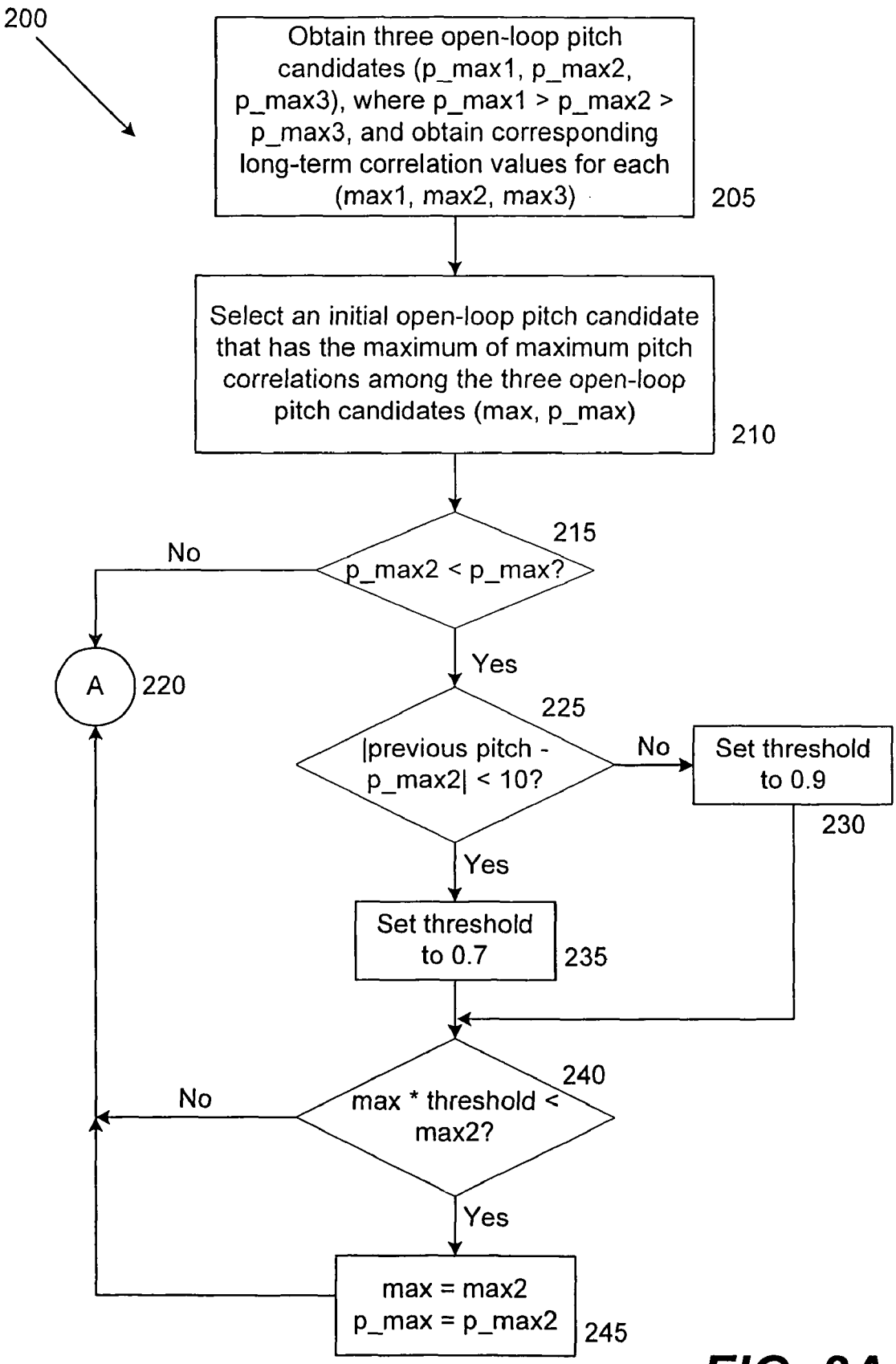
FIGS. 2A and 2B illustrate a flow diagram for performing an open-loop pitch analysis algorithm in an encoder, according to one embodiment of the present invention.
Figure 2B:
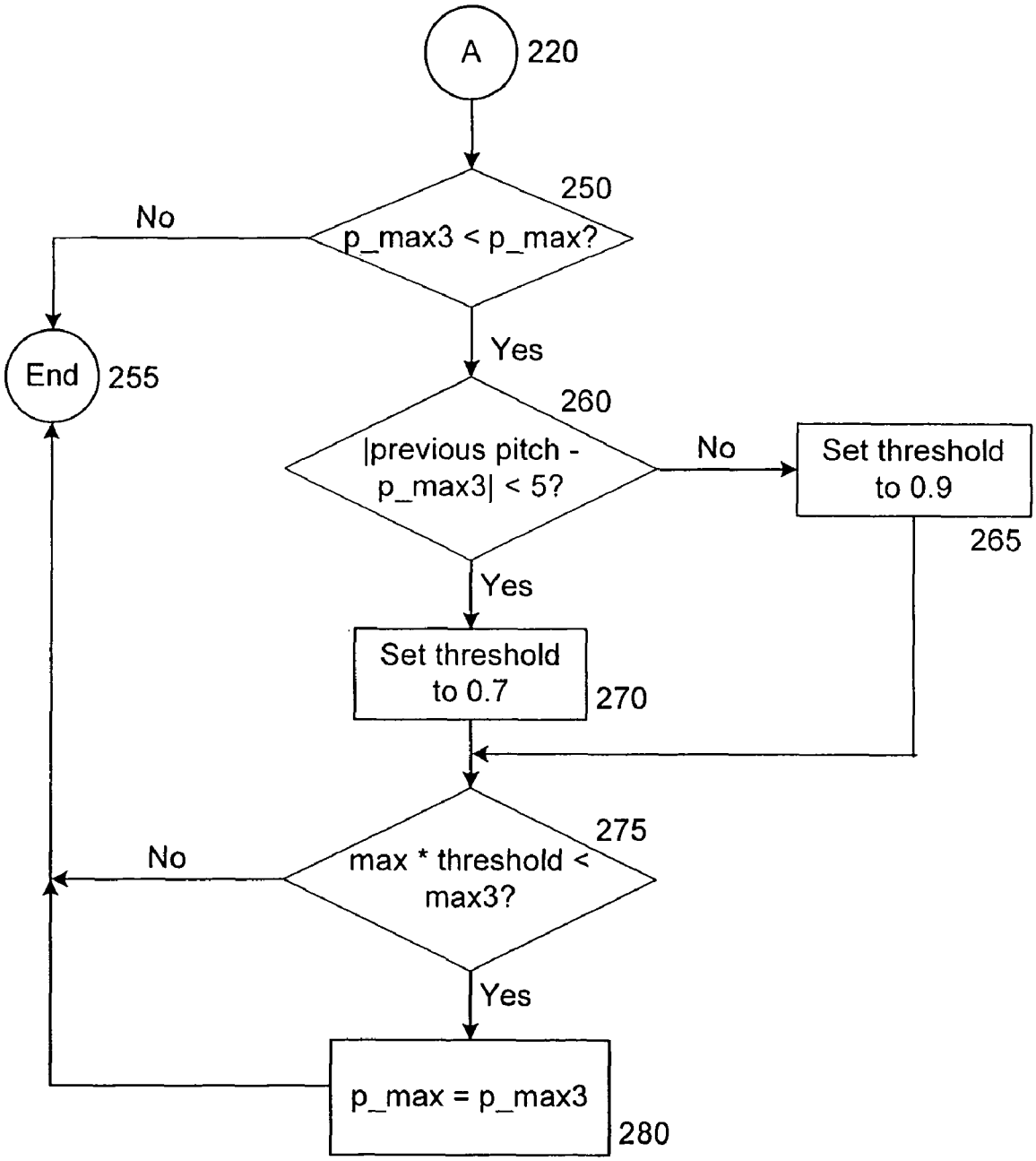

FIGS. 2A and 2B illustrate a flow diagram for performing open-loop pitch analysis (OLPA) algorithm 200 in an encoder, such as an encoder of the G.729 Recommendation, which is operated by a controller, according to one embodiment of the present invention. In one embodiment, OLPA algorithm 200 of the present invention provides a smoothed open-loop pitch track that improves the conventional algorithms by utilizing the voicing information from one or more previous frames.

As shown, OLPA algorithm 200 begins at step 205, where an initial open-loop pitch analysis obtains a number of open-loop pitch candidates form a number of searching ranges, such as three (3) open-loop pitch candidates from three (3) searching ranges, as follows:

{p_max1, max1}, {p_max2, max2}, {p_max3, max3}, where p_max1, p_max2 and p_max3 denote open-loop pitch candidates, and max1, max2 and max3 denote the corresponding long-term pitch correlation values for the open-loop pitch candidates, and where, p_max1>p_max2>p_max3. In one embodiment, the searching ranges are mutually exclusive.

Next, at step 210, OLPA algorithm 200 selects one of open-loop pitch candidates that has the maximum of maximum pitch long-term pitch correlation values among the open-loop pitch candidates, i.e. max=MAX{max1, max2, max3}, where max denotes the maximum of maximum pitch long-term pitch correlation value, and p_max denotes the open-loop pitch candidate corresponding to max. For example, if max2 has the maximum pitch long-term pitch correlation value as compared to max1 and max3, then, initially, p_max will be set to p_max2.

Subsequently, at steps 215-245, OLPA algorithm 200 performs the following operations, which are further described below.

```
If p_max2 < p_max                    step 215
    if (|pit _old – p _max 2|<10)    step 225
        thresh = 0.7;                step 235
    else
        thresh = 0.9;                step 230
    if (max*thresh<max2) {           step 240
        max=max2;                    step 245
        p_max=p_max2;                step 245
    }
                                     state 220
```

At step 215, OLPA algorithm 200 determines whether p_max2 is less than p_max. If so, OLPA algorithm 200 moves to step 225, otherwise, OLPA algorithm 200 moves to state 220. At step 225, OLPA algorithm 200 determines whether a previous pitch less p_max2 is less than a predetermined value, e.g. an absolute value of the previous pitch less p_max2 being less than 10. As noted above, unlike conventional approaches, OLPA algorithm 200 uses information from one or more previous frame(s). For example, at step 225, the pitch information of a previous frame, e.g. an immediate previous frame, is used in OLPA algorithm 200 for providing a smoothed open-loop pitch track. In other embodiments, several pitch values of previous frames, one pitch value of a previous frame other than an immediate previous frame, or other information from previous frames may be utilized for smoothing the open-loop pitch track. Turning back to step 225, if the previous pitch less p_max2 is less than the predetermined value, OLPA algorithm 200 proceeds to step 235, where a threshold value is set to a predetermined value, e.g. 0.7. Otherwise, OLPA algorithm 200 proceeds to step 230, where the threshold value is set to a different predetermined value, e.g. 0.9. In either case, after steps 230 and 235, OLPA algorithm 200 moves to step 240, where it is determined whether max multiplied by the threshold value, which is determined at step 230 or 235, is less than max2. If not, OLPA algorithm 200 moves to state 220, which is described below. Otherwise, OLPA algorithm 200 moves to step 245, where max receives the value of max2, and p_max receives the value of p_max2. In other words, at this point, p_max2 is selected as the interim open-loop pitch. After step 245, OLPA algorithm 200 further moves to state 220, which is described below.

Turning to state 220, it is the starting state for the process performed at steps 250-280, where OLPA algorithm 200 performs the following operations, which are further described below.

```
If p_max3 < p_max                    step 250
    if (|pit _old – p _max 3|<5)     step 260
        thresh = 0.7;                step 270
    else
        thresh = 0.9;                step 265
    if (max*thresh<max3) {           step 275
            p_max=p_max3;            step 280
    }
                                     step 255
```

From state 220, OLPA algorithm 200 proceeds to step 250, where OLPA algorithm 200 determines whether p_max3 is less than p_max. If so, OLPA algorithm 200 moves to step 260, otherwise, OLPA algorithm 200 moves to state 255. At step 260, OLPA algorithm 200 determines whether a previous pitch less p_max3 is less than a predetermined value, e.g. an absolute value of the previous pitch less p_max3 being less than 5. As noted above, unlike conventional approaches, OLPA algorithm 200 uses information from one or more previous frame(s). For example, at step 260, the pitch information of a previous frame, e.g. an immediate previous frame, is used in OLPA algorithm 200 for providing a smoothed open-loop pitch track. In other embodiments, several pitch values of previous frames, one pitch value of a previous frame other than an immediate previous frame, or other information from previous frames may be utilized for smoothing the open-loop pitch track. Turning back to step 260, if the previous pitch less p_max3 is less than the predetermined value, OLPA algorithm 200 proceeds to step 270, where a threshold value is set to a predetermined value, e.g. 0.7. Otherwise, OLPA algorithm 200 proceeds to step 265, where the threshold value is set to a different predetermined value, e.g. 0.9. In either case, after steps 265 and 270, OLPA algorithm 200 moves to step 275, where it is determined whether max multiplied by the threshold value, which is determined at step 265 and 270, is less than max3. If not, OLPA algorithm 200 moves to state 255, which is described below. Otherwise, OLPA algorithm 200 moves to step 280, where p_max receives the value of p_max3. In other words, at this point, p_max3 is selected as the open-loop pitch. After step 280, OLPA algorithm 200 further moves to state 255, which is described below.

At step 255, OLPA algorithm 200 ends and the current value p_max indicates the value of the selected open-loop pitch, and max indicates the corresponding long-term pitch correlation for p_max.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

What is claimed is:

1. A method of performing an open-loop pitch analysis using a circuitry, the method comprising:

obtaining, using the circuitry, a plurality of open-loop pitch candidates including a first open-loop pitch candidate (p_max1), a second open-loop pitch candidate (p_max2) and a third open-loop pitch candidate (p_max3), wherein p_max1>p_max2>p_max3;

obtaining, using the circuitry, a plurality of long-term correlation values, including a first correlation value (max1), a second correlation value (max2) and a third correlation value (max3), for each corresponding one of the plurality of open-loop pitch candidates;

selecting, using the circuitry, an initial open-loop pitch (max) from the plurality of open-loop pitch candidates, wherein the long-term correlation value corresponding to max (p_max) has the maximum long-term correlation value among the long-term correlation values;

if p_max2 is less than p_max, setting a first threshold value to a first pre-determined threshold value if an absolute value of a previous pitch less p_max2 is less than a first pre-determined comparison value and setting the first threshold value to a second pre-determined threshold value if the absolute value of the previous pitch less p_max2 is not less than the first pre-determined comparison value;

if max multiplied by the first threshold value is less than max2, setting max to max2 and p_max to p_max2;

if p_max3 is less than p_max, setting a second threshold value to a third pre-determined threshold value if an absolute value of a previous pitch less p_max3 is less than a second pre-determined comparison value and setting the second threshold value to a fourth pre-determined threshold value if the absolute value of the previous pitch less p_max3 is not less than the second pre-determined comparison value; and if max multiplied by the second threshold value is less than max3, setting p_max to p_max3.

2. The method of claim 1, wherein the first pre-determined comparison value is 10, the first pre-determined threshold value is 0.7 and the second pre-determined threshold value is 0.9.

3. The method of claim 2, wherein the second pre-determined comparison value is 5, the third pre-determined threshold value is 0.7 and the fourth pre-determined threshold value is 0.9.

4. The method of claim 1, wherein the previous pitch is from one or more previous frames.

5. The method of claim 1, wherein the previous pitch is from an immediate previous frame.

6. A speech encoder for performing an open-loop pitch analysis, the speech encoder comprising:

a controller configured to:

obtain a plurality of open-loop pitch candidates including a first open-loop pitch candidate (p_max1), a second open-loop pitch candidate (p_max2) and a third open-loop pitch candidate (p_max3), wherein p_maxl>p_max2>p_max3;

obtain a plurality of long-term correlation values, including a first correlation value (max1), a second correlation value (max2) and a third correlation value (max3), for each corresponding one of the plurality of open-loop pitch candidates;

select an initial open-loop pitch (max) from the plurality of open-loop pitch candidates, wherein the long-term correlation value corresponding to max (p_max) has the maximum long-term correlation value among the long-term correlation values;

if p_max2 is less than p_max, set a first threshold value to a first pre-determined threshold value if an absolute value of a previous pitch less p_max2 is less than a first pre-determined comparison value and set the first threshold value to a second pre-determined threshold value if the absolute value of the previous pitch less p_max2 is not less than the first pre-determined comparison value;

if max multiplied by the first threshold value is less than max2, set max to max2 and p_max to p_max2;

if p_max3 is less than p_max, set a second threshold value to a third pre-determined threshold value if an absolute value of a previous pitch less p max3 is less than a second pre-determined comparison value and set the second threshold value to a fourth pre-determined threshold value if the absolute value of the previous pitch less p_max3 is not less than the second pre-determined comparison value; and if max multiplied by the second threshold value is less than max3, set p_max to p_max3.

7. The speech encoder of claim 6, wherein the first pre-determined comparison value is 10, the first pre-determined threshold value is 0.7 and the second pre-determined threshold value is 0.9.

8. The speech encoder of claim 7, wherein the second pre-determined comparison value is 5, the third pre-determined threshold value is 0.7 and the fourth pre-determined threshold value is 0.9.

9. The speech encoder of claim 6, wherein the previous pitch is from one or more previous frames.

10. The speech encoder of claim 6, wherein the previous pitch is from an immediate previous frame.

11. A method of performing an open-loop pitch analysis, using a circuitry, the method comprising:

obtaining, using the circuitry, a plurality of open-loop pitch candidates including a first open-loop pitch candidate (p_max1), a second open-loop pitch candidate (p_max2) and a third open-loop pitch candidate (p_max3), wherein p_max1>p_max2>p_max3;

obtaining, using the circuitry, a plurality of long-term correlation values, including a first correlation value (max1), a second correlation value (max2) and a third correlation value (max3), for each corresponding one of the plurality of open-loop pitch candidates;

selecting, using the circuitry, an initial open-loop pitch (max) from the plurality of open-loop pitch candidates, wherein the long-term correlation value corresponding to max (p_max) has the maximum long-term correlation value among the long-term correlation values;

if p_max2 is less than p_max, setting max to max2 and p_max to p_max2 based on a first decision; and if p_max3 is less than p_max, setting p_max to p_max3 based on a second decision.

12. The method of claim 11 further comprising:

obtaining a voicing information from one or more previous frames; and using the voicing information from the one or more previous frames for each of the first decision and the second decision.

13. The method of claim 12, wherein the voicing information from the one or more previous frames includes a previous pitch of the one or more previous frames.

14. The method of claim 12, wherein the voicing information from the one or more previous frames is a pitch from an immediate previous frame.

15. The method of claim 11, where the first decision including:

setting a first threshold value to a first pre-determined threshold value if an absolute value of a previous pitch less p_max2 is less than a first pre-determined comparison value and setting the first threshold value to a second pre-determined threshold value if the absolute value of the previous pitch less p_max2 is not less than the first pre-determined comparison value; and determining if max multiplied by the first threshold value is less than max2.

16. The method of claim 15, wherein the first pre-determined comparison value is 10, the first pre-determined threshold value is 0.7 and the second pre-determined threshold value is 0.9.

17. A speech encoder for performing an open-loop pitch analysis, the speech encoder comprising:

a controller configured to:

obtain a plurality of open-loop pitch candidates including a first open-loop pitch candidate (p_max1), a second open-loop pitch candidate (p_max2) and a third open-loop pitch candidate (p_max3), wherein p_max2>p_max2>p_max3;

obtain a plurality of long-term correlation values, including a first correlation value (max1), a second correlation value (max2) and a third correlation value (max3), for each corresponding one of the plurality of open-loop pitch candidates;

select an initial open-loop pitch (max) from the plurality of open-loop pitch candidates, wherein the long-term correlation value corresponding to max (p_max) has the maximum long-term correlation value among the long-term correlation values;

if p_max2 is less than p_max, set max to max2 and p_max to p_Max2 based on a first decision; and if p_max3 is less than p_max, set p_max to p_max3 based on a second decision.

18. The speech encoder of claim 17, wherein the controller is further configured to:

obtain a voicing information from one or more previous frames; and use the voicing information from the one or more previous frames for each of the first decision and the second decision.

19. The speech encoder of claim 18, wherein the voicing information from the one or more previous frames includes a previous pitch of the one or more previous frames.

20. The speech encoder of claim 18, wherein the voicing information from the one or more previous frames is a pitch from an immediate previous frame.

21. The speech encoder of claim 17, where the first decision including:

setting a first threshold value to a first pre-determined threshold value if an absolute value of a previous pitch less p_max2 is less than a first pre-determined comparison value and setting the first threshold value to a second pre-determined threshold value if the absolute value of the previous pitch less p_max2 is not less than the first pre-determined comparison value; and determining if max multiplied by the first threshold value is less than max2.

22. The speech encoder of claim 21, wherein the first pre-determined comparison value is 10, the first pre-determined threshold value is 0.7 and the second pre-determined threshold value is 0.9.

* * * * *

UNITED STATES PATENT AND TRADEMARK OFFICE

CERTIFICATE OF CORRECTION

PATENT NO. : 8,386,245 B2
APPLICATION NO. : 12/224003
DATED : February 26, 2013
INVENTOR(S) : Yang Gao It is certified that error appears in the above-identified patent and that said Letters Patent is hereby corrected as shown below:

In the claims

Column 7, line 13, “p¯max3” should be changed to --p_max3--.

Column 7, line 33, “p¯max2” should be changed to --p_max2--.

Column 8, line 23, “p max3” should be changed to --p_max3--.

Column 10, line 7, “p_Max2” should be changed to --p_max2--.

Signed and Sealed this
Eighteenth Day of February, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,386,245 B2
APPLICATION NO. : 12/224003
DATED : February 26, 2013
INVENTOR(S) : Yang Gao It is certified that error appears in the above-identified patent and that said Letters Patent is hereby corrected as shown below:

In the Claims

Col. 7, line 20, "(max)" should be --(p_max)--.

Col. 7, line 22, "max (p_max)" should be --p_max (max)--.

Col. 8, line 3, "(max)" should be --(p_max)--.

Col. 8, line 5, "max (p_max)" should be --p_max (max)--.

Col. 8, line 57, "(max)" should be --(p_max)--.

Col. 8, line 59, "max (p_max)" should be --p_max (max)--.

Col. 10, line 1, "(max)" should be --(p_max)--.

Col. 10, line 3, "max (p_max)" should be --p_max (max)--.

Signed and Sealed this
Third Day of February, 2015

Michelle K. Lee

Michelle K. Lee
*Deputy Director of the United States Patent and Trademark Office*